US006533269B2

(12) United States Patent
Butterfass et al.

(10) Patent No.: US 6,533,269 B2
(45) Date of Patent: Mar. 18, 2003

(54) METHOD AND DEVICE FOR ALIGNING STACKED SHEETS IN A FEEDER OF A SHEET-PROCESSING MACHINE

(75) Inventors: Hans Butterfass, Heidelberg (DE); Wolfgang Dolz, Heidelberg (DE); Jürgen Zeltner, Hirschberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 189 days.

(21) Appl. No.: 09/755,682

(22) Filed: Jan. 5, 2001

(65) Prior Publication Data

US 2001/0006273 A1 Jul. 5, 2001

(30) Foreign Application Priority Data

Jan. 5, 2000 (DE) ..... 100 00 307

(51) Int. Cl.[7] ..... B65H 9/00
(52) U.S. Cl. ..... 271/236
(58) Field of Search ..... 271/236

(56) References Cited

U.S. PATENT DOCUMENTS 4,589,654 A * 5/1986 Kanoto ..... 271/184
5,415,390 A * 5/1995 Guerrero ..... 271/215
5,613,671 A 3/1997 Fricke et al.
6,267,372 B1 * 7/2001 Mylaeus et al. ..... 271/226

* cited by examiner

*Primary Examiner*—Donald P. Walsh
*Assistant Examiner*—Kenneth W Bower
(74) *Attorney, Agent, or Firm*—Laurence A. Greenberg; Werner H. Stemer; Ralph E. Locher

(57) ABSTRACT

A method and device for aligning stacked or piled sheets in a feeder of a sheet-processing machine, wherein a sheet to be separated is pivotable about a vertical axis extending at least approximately orthogonally to a transport direction of the sheet, as viewed in the transport direction thereof, in order to correct a skewed position of a leading edge thereof relative to at least one front lay. The method further includes determining, relative to the front lay, a skewed position of sheets oncoming at the front lay or resting at the top of the sheet pile, and displacing, transversely or approximately transversely to the transport direction, either the sheet pile, before the sheet is lifted therefrom, or the sheet lifted off the sheet pile, depending upon the determined skewed position, over a displacement distance that is of such length that, after the skewed-position correction, there is a defined spaced distance between a side edge of the sheet and at least one side lay.

12 Claims, 5 Drawing Sheets

METHOD AND DEVICE FOR ALIGNING STACKED SHEETS IN A FEEDER OF A SHEET-PROCESSING MACHINE

BACKGROUND OF THE INVENTION

Field of the Invention

The invention relates to a method of aligning stacked or piled sheets in a feeder of a sheet-processing machine, wherein a sheet to be separated is pivotable about a vertical axis extending orthogonally to a transport direction of the sheet, as viewed in the transport direction thereof, in order to correct a skewed position of a leading edge thereof, relative to at least one front lay. The invention also relates to a device for performing the method, including a sheet lifting device for lifting a sheet resting on the top of the stack or pile and for pivoting the sheet about a vertical axis extending to the transport direction of the separated sheet.

Aligning devices and methods implementable therewith, which are of the aforementioned type, have become known heretofore from the published German Patent Document DE 44 10 529 C2. The aligning device is employed in the feeder of a sheet-fed printing machine and is used for precise alignment of a sheet lifted off a sheet pile on a transport path of the sheet from the sheet pile to front lays engaged thereby, the front lays serving to ensure a perpendicular alignment of the sheet leading edge to the transport direction of the sheet, and side lays for exactly positioning the sheet in the printing unit. The aligning device has a sheet lifting device by which the uppermost sheet, respectively, on the sheet pile, is lifted at the trailing region thereof and is pivotable about a vertical axis extending perpendicularly to the transport direction of the sheet, in order to compensate for a skewed position of the sheet. After the sheet has been moved into engagement with the front lays, it is shifted transversely with respect to the transport direction until it comes into contact with the side lays. The lateral displacement path of the sheet depends upon their skewed position on the sheet pile, which means that the greater the skewed position of the sheet resting on the sheet pile, which is to be compensated for by pivoting the sheet about the vertical axis thereof as the sheet is lifted from the sheet pile, the greater is the lateral displacement path towards the side lays. Depending upon the direction of the skewed position, the displacement path can be longer or shorter. However, because the time window for the alignment of each sheet on the front and side lays is of equal length for each sheet, the displacement path should be kept approximately constant, because otherwise, depending upon the direction, the time window for lateral alignment may no longer be sufficient, or the sheet can remain caught on the side lay.

SUMMARY OF THE INVENTION

It is therefore an object of the invention to provide a method and a device for aligning stacked or piled sheets in a feeder of a sheet-processing machine, of the type mentioned in the introduction hereto, wherein it is possible to ensure that the sheets lifted off the sheet pile, after the alignment of the leading edge thereof, are aligned perpendicularly to the transport direction, and that the lateral displacement path of the sheets towards the side lay is at least approximately equal in length for all of the sheets, regardless of the magnitude of the skewed position thereof before the alignment.

With the foregoing and other objects in view, there is provided, in accordance with one aspect of the invention, a method of aligning stacked or piled sheets in a feeder of a sheet-processing machine, wherein a sheet to be separated is pivotable about a vertical axis extending orthogonally to a transport direction of the sheet, as viewed in the transport direction, in order to correct a skewed position of a leading edge thereof relative to at least one front lay. The method comprises determining, relative to the front lay, a skewed position of sheets present at the front lay or on the top of the sheet pile, and displacing, transversely to the transport direction, with the sheet pile, before the sheet is lifted therefrom, or the sheet lifted off the sheet pile, depending upon the determined skewed position, over a displacement distance that is of such length that, after the skewed-position correction, there is a defined spaced distance between a side edge of the sheet and at least one side lay.

In accordance with another mode of the method invention, the defined spaced distance, after the skewed-position correction, is of equal length for all of the separated sheets, respectively.

In accordance with a further mode, the method of the invention includes determining the skewed position of the sheet visually by an operator.

In accordance with an added mode, the method of the invention includes defining by the operator an adjustment angle by which the sheet to be aligned is pivoted about the vertical axis for the purpose of correcting the skewed position.

In accordance with an additional mode, the method of the invention includes determining the displacement distance in accordance with an adjustment angle.

In accordance with yet another mode, the method of the invention includes calculating the displacement distance in accordance with an adjustment angle.

In accordance with yet a further mode, the method of the invention includes automatically registering the skewed position of the sheet with the aid of at least one sensor.

In accordance with yet an added mode, the method of the invention includes calculating by a control and/or regulating device the necessary correction of the skewed position of the sheet in accordance with the determined skewed sheet position.

In accordance with yet an additional mode, the method of the invention includes calculating the displacement distance in accordance with the value of the skewed-position correction.

In accordance with still another mode, the method of the invention includes activating by the control and/or regulating device actuators associated with the sheet pile and the sheet lifted off the sheet pile in accordance with the calculated skewed-position correction value and the displacement distance.

In accordance with another aspect of the invention, there is provided a device for aligning stacked sheets in a feeder of a sheet-processing machine, including a sheet lifting device for lifting a sheet resting on the top of a sheet stack or pile and for pivoting the sheet about a vertical axis extending at least approximately orthogonal to the transport direction of the separated sheet, comprising at least one of a pile displacement device for displacing the sheet pile at least approximately transversely to the transport direction of the separated sheets and of at least one lifting element that is displaceable at least transversely to the transport direction of the separated sheets.

In accordance with a concomitant feature of the invention, the aligning device includes a control and/or regulating device for respectively controlling/regulating the pivoting of the sheet, and the displacement of the sheet pile transversely to the transport direction of the separated sheets.

In order to achieve the object of the invention, a method is thus proposed, which is distinguished by the fact that the skewed position of the sheets arriving at or present at the front lay or of the sheet resting or present at the top of the pile is determined relative to the front lay, and that the pile, before the sheet is lifted therefrom, and/or the sheet lifted off the pile is displaced transversely or virtually transversely to the transport direction, depending upon the determined skewed position, over a displacement distance, that is of such length that, following the skewed-position correction, there is a defined distance between a side edge of the sheet and at least one side lay.

According to a first alternative, therefore, provision is made for the entire sheet pile to be moved transversely to the transport direction of the sheets a displaced distance which depends upon the skewed position of the sheets arriving at the front lay or of the sheet resting at the top of the sheet pile, so that after the sheet has been lifted off the sheet pile and after the skewed-position correction thereof, which is implemented by appropriate pivoting of the sheet about a vertical axis so that the leading edge of the sheet extends perpendicularly to the transport direction of the sheets, there is approximately a preselectable or predefined distance between the side edge of the sheet and the side lay.

In another alternative, only the lifted top sheet is shifted a given amount corresponding to the displacement distance transversely to the transport direction, it being possible for this to be done before, during or after the skewed-position correction.

According to a third alternative, provision is made for both the sheet pile, while the top sheet is still resting on the latter, and the sheet itself, after the latter has already been lifted off the sheet pile, respectively, to be shifted over respective given partial distances which, when added vectorially, result precisely in the displacement distance, so that after the skewed-position correction, the sheet side edge is at a desired spaced distance from the side lay.

The common feature in all of the alternatives is that the spaced distance of the sheet from the side lay can be varied or preselected or defined. Particular preference is given to the procedure wherein the skewed position is determined when a sheet arrives at the front lay and is used to determine a trend in the skewed position. This trend is the starting information for the lateral shift over the displaced distance.

In a particularly preferred alternative, provision is made for the spaced distance, with regard to all of the separated sheets, to be equal in length, after the skewed-position correction. Therefore, the time wherein the aligned sheet is shifted or pulled laterally in the direction of the side lay is preferably of equal length for all of the sheets, regardless of the respective skewed position thereof on the sheet pile.

In order to achieve the object of the invention, a device for aligning stacked sheets in a feeder of a sheet-processing machine is also proposed. This device according to the invention includes a pile or stack displacement device for displacing the sheet pile or stack transversely or approximately transversely with respect to the transport direction of the separated sheets. Alternatively or additionally, the sheet lifting device has at least one lifting element which is displaceable transversely or approximately transversely with respect to the transport direction of the separated sheets and which, for example, can be constructed as a sucker. With the aid of the stack or pile displacement device and the sheet lifting device with the displaceable lifting element thereof, an alignment of the respective top sheet of the sheet pile or stack transversely with respect to the transport direction is possible in a desired manner, so that following a skewed-position correction of the lifted sheet, in the case of all sheets it is possible to implement an equally large distance between the sheet side edge and a side lay, regardless of the magnitude of the respective skewed position of the sheets before the skewed-position correction thereof.

Other features which are considered as characteristic for the invention are set forth in the appended claims.

Although the invention is illustrated and described herein as embodied in a method and device for aligning stacked sheets in the feeder of a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
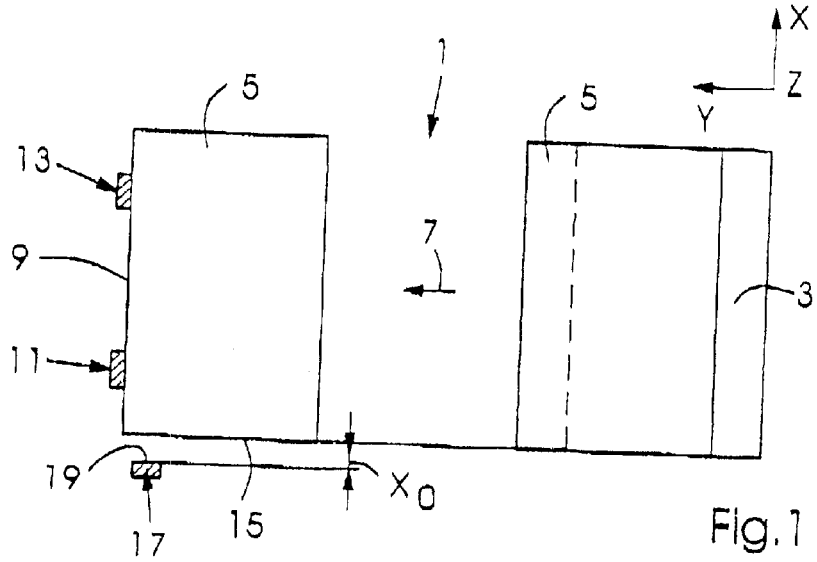
FIGS. 1 to 3 are diagrammatic plan views of a feeder of a sheet-processing machine, with a sheet lifted off a sheet pile in two positions.

Referring now to the drawings and, first, particularly to FIG. 1 thereof, there is shown therein, in a plan view, a non-detailed feeder 1 for separating or singling sheets stacked to form a sheet pile 3, and for feeding the sheets to a sheet-processing machine, such as a sheet-printing machine. In FIG. 1, a sheet 5 lifted off the sheet pile 3 is illustrated in a number of positions, in a first position the sheet being lifted off the straight sheet pile 3, i.e, the sheet pile having no sheets in a skewed position, and already being displaced some distance in the transport direction y (note the arrow 7). In a second position, a leading edge 9 of the sheet 5 impacts front lays 11 and 13, while a side edge 15 of the sheet 5 is disposed at a distance $X_0$ from a side lay 17. In order to align the sheet 5 exactly with respect to the non-illustrated machine following downline therefrom, the sheet 5 is displaced the distance $X_0$ perpendicularly to the transport direction y, so that the side edge 15 of the sheet 5 comes to rest against the side lay 17. Because the sheet 5 or the sheet pile 3 is not in a skewed position, which means that the leading edge 9 of the sheet 5 extends exactly at right angles to the transport direction y, and the side edge 15 of the sheet 5 extends at a distance $X_0$ parallel to a contact surface 19 of the side lay 17, the sheet 5 merely has to be lifted off the sheet pile 3 and displaced in the transport direction y.

Figure 2:
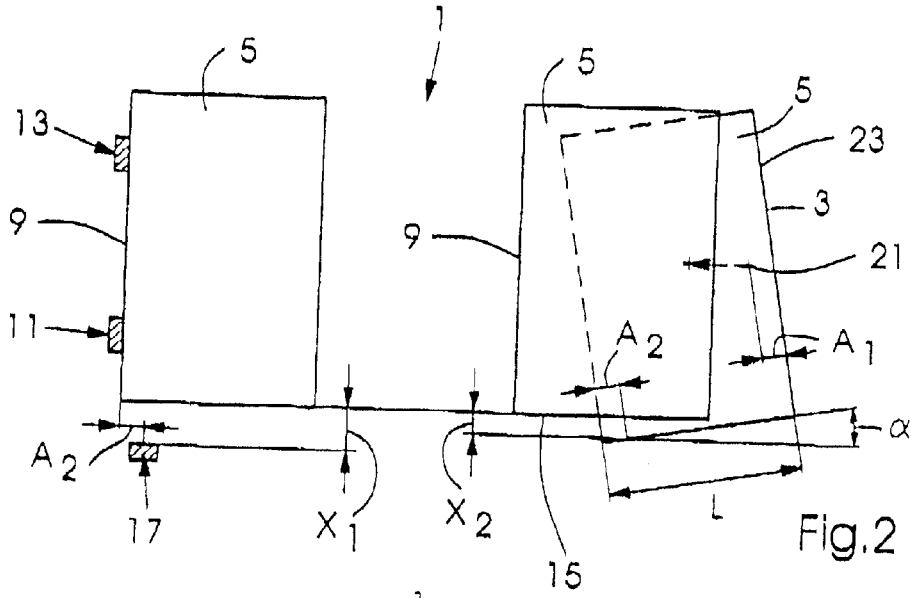

In FIG. 2, the sheet pile 3 is in a skewed position with respect to the transport direction y. In order to align the sheet 5 lifted off the sheet pile 3, the sheet 5 is pivoted by a non-illustrated sheet lifting device about a vertical axis 21 extending orthogonally or approximately orthogonally, i.e., perpendicularly or approximately perpendicularly, to the plane of FIG. 2, so that the leading edge 9 of the sheet 5 is then aligned precisely or nearly precisely at right angles to the transport direction y. Following the skewed-position correction, the side edge 15 of the sheet 5 is spaced a distance $X_1$ from the side lay 17, which is greater by a distance $X_2$ than the distance $X_0$ of the sheet illustrated in FIG. 1, wherein a skewed-position correction was made.

In order to ensure that, even after a skewed-position correction, i.e., the sheet 5 has been pivoted about the vertical axis 21, so that the leading edge 9 extends transversely to the sheet transport direction y, the side edge 15 of the sheet 5 is at the desired distance $X_0$ from the side lay 17, the invention provides for the entire sheet pile 3 to be moved transversely with respect to the transport direction, i.e. in the x direction, over a distance S before the sheet 5 lying on the top of the sheet pile 3 is lifted and pivoted about the vertical axis 21.

Figure 3:
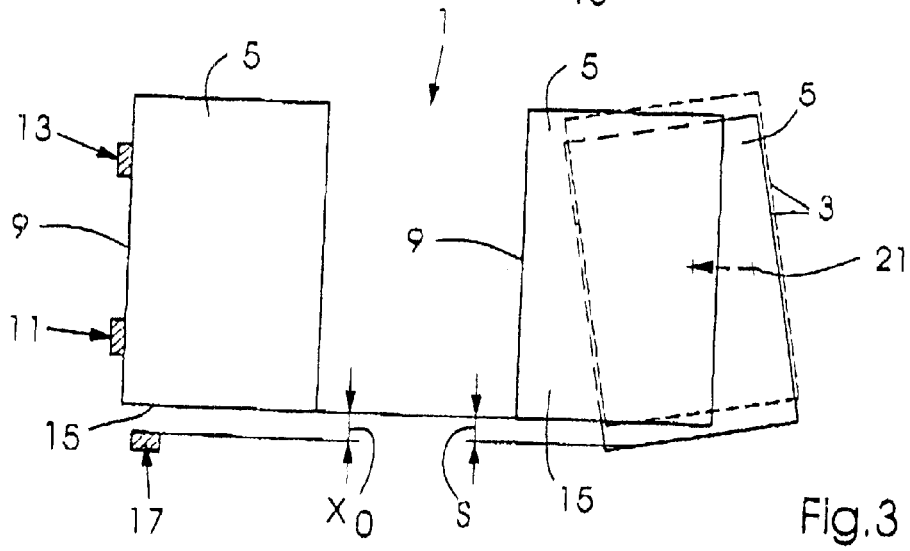

In FIG. 3, the sheet pile 3 in a skewed position is illustrated by broken lines before it is moved in the x direction, and by solid lines in the position thereof following a displacement thereof over the distance S in the x direction. The displaced distance S is calculated as follows:

$$S=(L-A_1-A_2)\cdot\sin\alpha,$$

where L is the length of the sheet, $A_1$ is the distance of the vertical axis 21 from the trailing edge 23 of the sheet 5, and $A_2$ is the distance between the impact or contact region of the sheet 5 with the side lays 17 and the leading edge 9.

Figure 4:
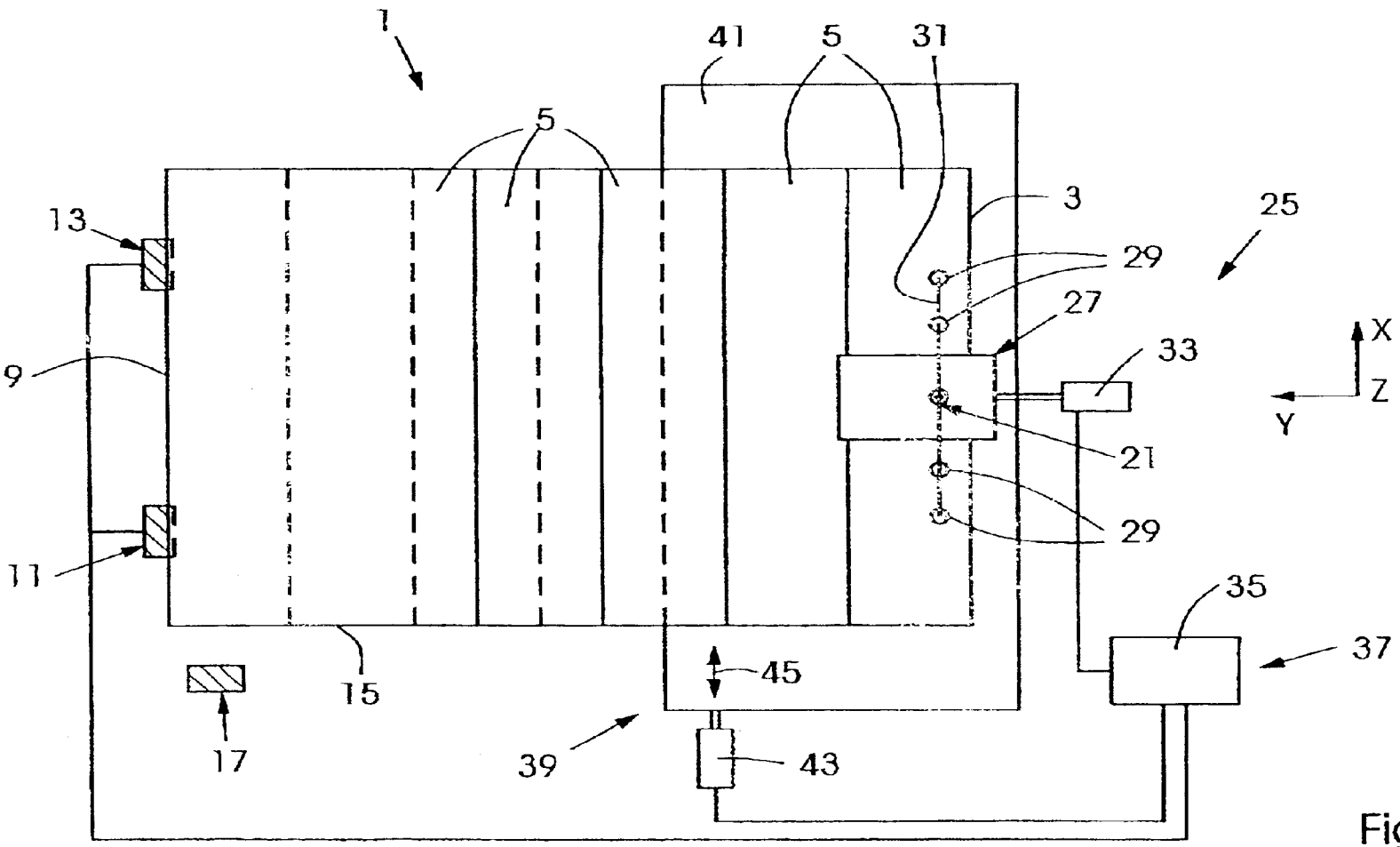
FIG. 4 is an enlarged diagrammatic plan view of any of FIGS. 1 to 3, showing the feeder provided with a first exemplary embodiment of the aligning device according to the invention.

FIG. 4 shows an exemplary embodiment of a device 25 for aligning stacked sheets in the feeder 1. The aligning device 25 includes a sheet lifting device 27, which is arranged above the sheet pile 3 and has at least one lifting element, namely four lifting elements 29 in this exemplary embodiment, which are pivotable about a common vertical axis 21. The vertical axis 21 extends orthogonally to the transport direction y of the sheets 5, i.e., at right angles to the plane of FIG. 4. The lifting elements 29 can be constructed, for example, as lifting suckers which are movable in the z direction. The lifting elements 29 are arranged here, in a purely exemplary manner, on a pivoting lever 31, which is pivotable in clockwise and counterclockwise direction about the vertical axis 21 with the aid of a first motor 33. The first motor 33 is connected to a control computer 35, which is part of a control and/or regulating device 37.

The aligning device 25 also has a stack or pile displacement device 39, which includes a pile carrier 41 displaceable in either direction of a double-headed arrow 45, transversely to the transport direction y of the sheets, by the aid of a second motor 43. The second motor 43 is likewise connected to the control computer 35. Consequently, the front lays 11 and 13 which, in this exemplary embodiment, are equipped with non-illustrated sensors for detecting the arrival of the sheets 5, are connected to the control computer 35.

In FIG. 4, the sheet 5 lifted off the sheet pile or stack 3 is illustrated in a number of positions, still resting on the sheet pile or stack 3 in a first position and, in a fifth position, impacting the front lays 11 and 13 by the leading edge 9 of the sheet 5.

With the aid of the aligning device 25 illustrated in FIG. 4, an automated correction of the skewed position of the sheet 5 can be implemented, it being possible, at the same time, for a desired distance X between the side edge 15 of the sheet 5 and the side lay 17 to be adjusted after a skewed-position correction, which is discussed hereinafter in greater detail with reference to FIG. 5, which is a flow chart depicting the operation of the aligning device 25 illustrated in FIG. 4.

Initially, with the aid of at least one sensor, a determination is made at 50 whether the sheets are arriving in a straight line at the front lay on the drive side and the operator side and, if not, how great the deviation is. If it is determined that the average of the separated sheets 5 is being supplied skewed at 51, the control computer 35 calculates the necessary skewed-sheet correction at 52, i.e., the number of degrees by which the sheet 5 must be pivoted about the vertical axis 21 in order that the leading edge 9 of the sheet 5 be arranged exactly or nearly exactly at right angles to the transport direction y of the sheets. The control computer 35 uses the value of the skewed-sheet correction to calculate the necessary lateral displacement of the side edge 15 of the sheet 5 of the imbricated formation of sheets in the x direction, i.e., transversely to the transport direction y of the sheets, at 53, so that, after the skewed-sheet correction has been performed, there is a desired distance $X_0$ between the side edge 15 of the sheet 5 and the side lay 17, as described with respect to FIG. 3. The control computer 35 activates the first motor 33 at 54 appropriately for the purpose of skewed-sheet correction, so that the sheet 5, preferably after it has been lifted off the sheet pile 3, is pivoted about the vertical axis 21 the calculated angular range, at 55. In addition, the control computer 35 activates the second motor 43 also at 54, so that the latter displaces the stack or pile carrier 41 with the sheet stack or pile 3 disposed thereon by the necessary displacement travel S transversely with respect to the transport direction y, also at 55.

Because the skewed position of the sheets 5 is determined only when they arrive at the front lay, no correction is possible for the incoming sheet. For this reason, the arrival of all the sheets 5 at the front lay is observed continuously, and a trend relating to skewed sheet arrival is determined. This trend is corrected by the skewed-sheet control system and the pile or stack is appropriately moved sideways so that the sheets on average arrive straight at the front lays and at the distance $X_0$ from the pull or side lay.

Figure 5:
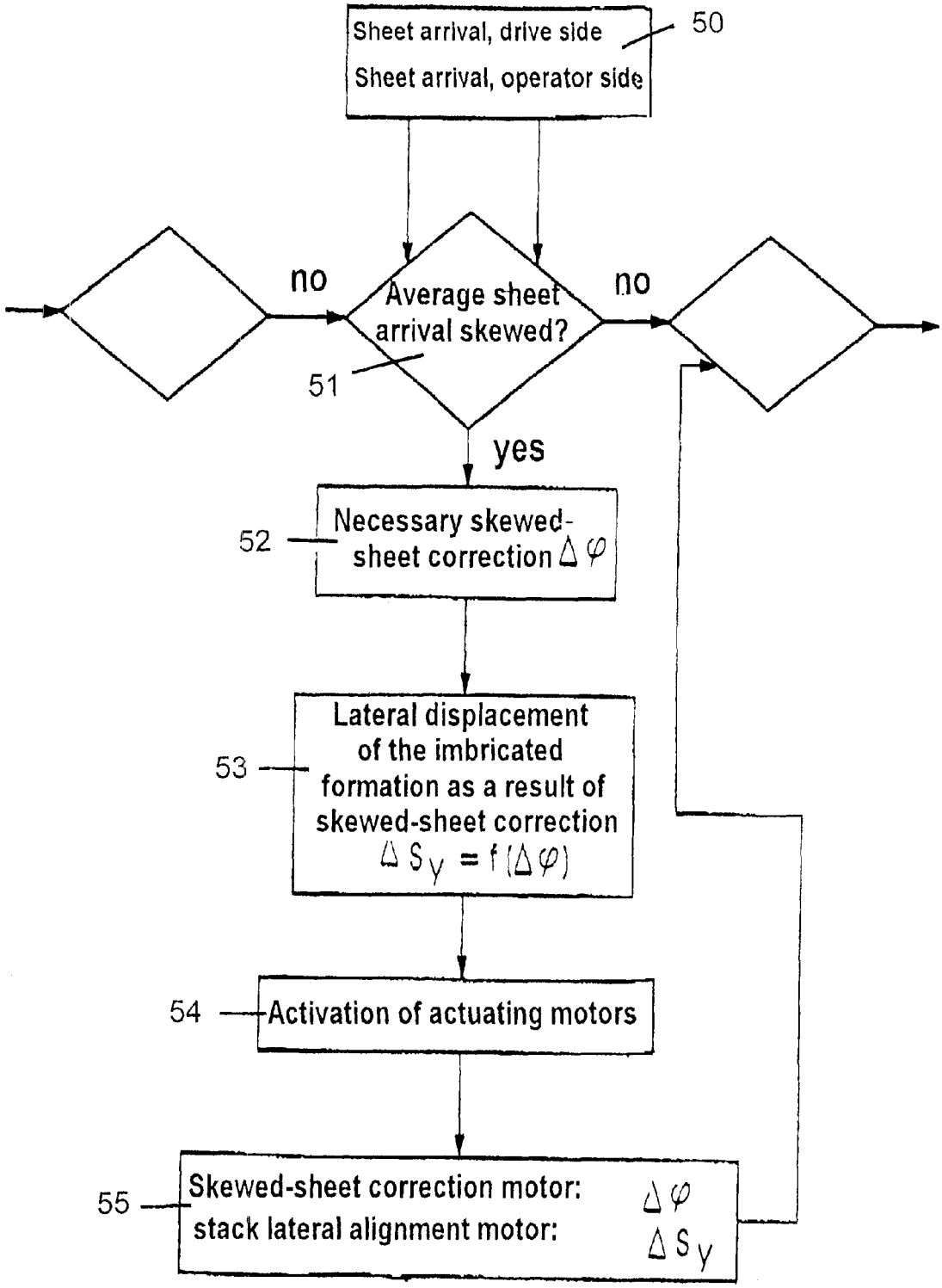
FIG. 5 is a flow chart depicting the operation of the embodiment of the aligning device illustrated in FIG. 4.
Figure 6:
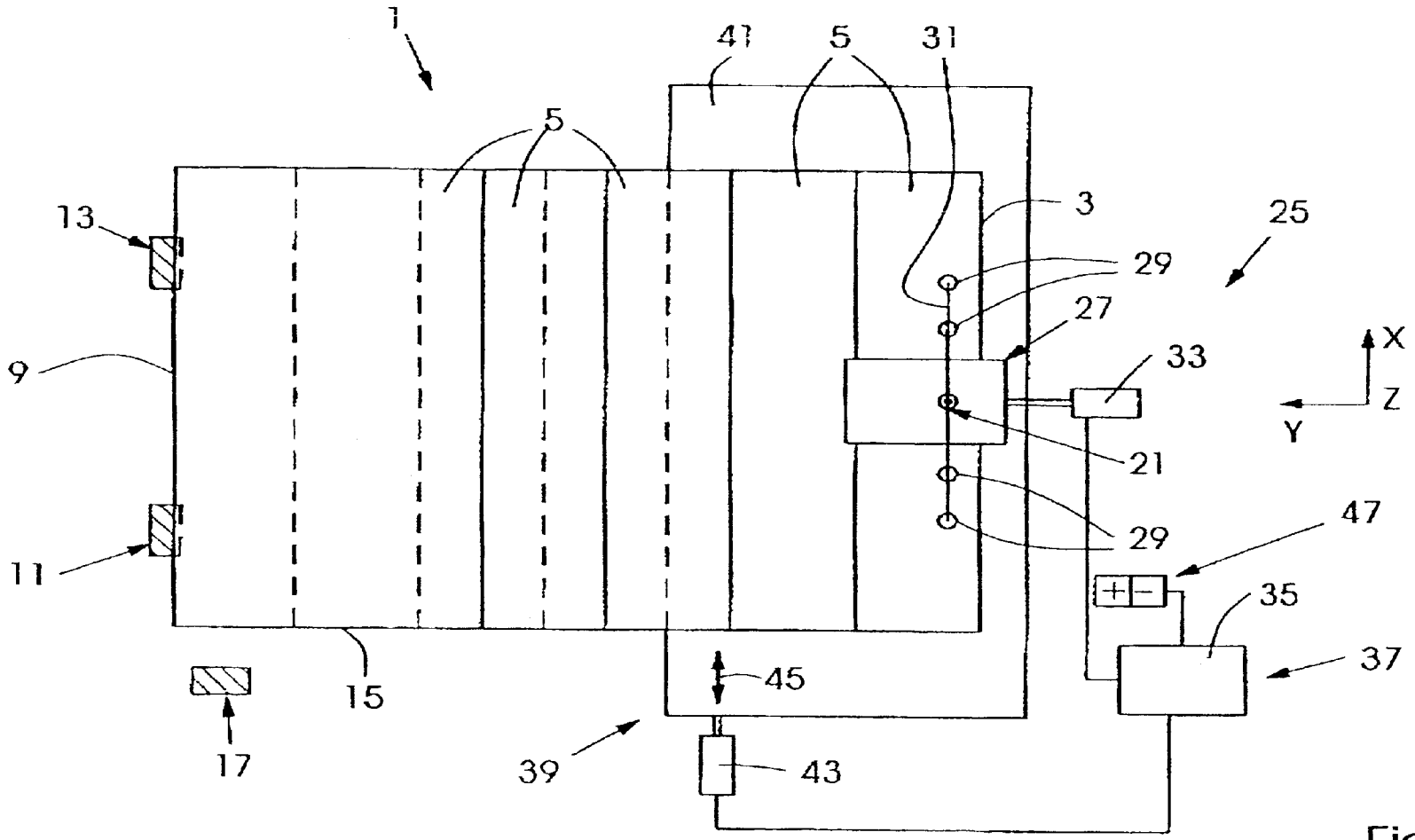
FIG. 6 is a view like that of FIG. 4 of the feeder with a further exemplary embodiment of the aligning device.
Figure 7:
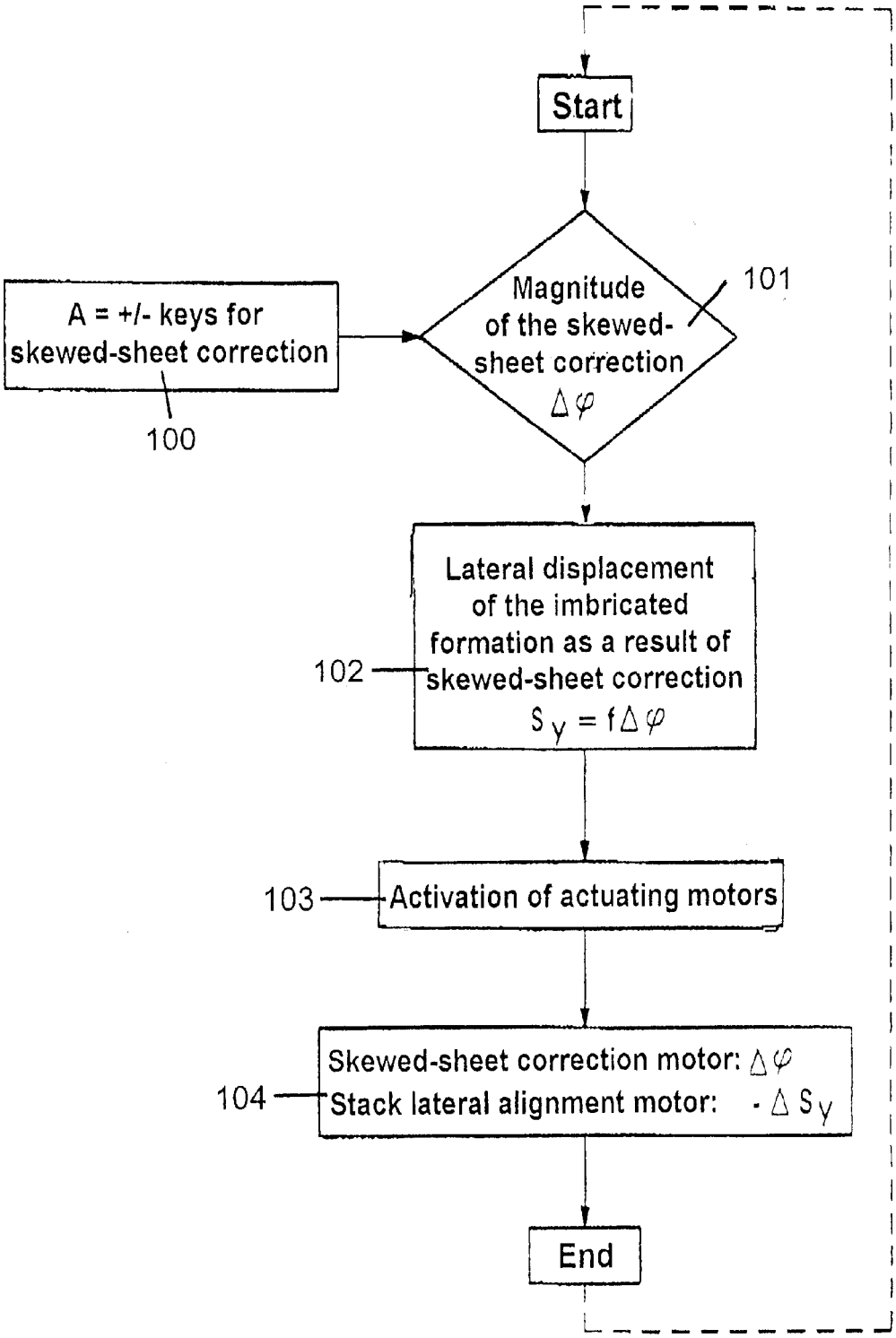
FIG. 7 is a flow chart depicting the operation of the embodiment of the aligning device illustrated in FIG. 6.

FIG. 6 shows a further exemplary embodiment of the aligning device 25, which differs from the exemplary embodiment described with respect to FIGS. 4 and 5, in particular, in that the detection of the skewed position of the sheet 5 or of the sheet pile 3 is not performed by sensors but by a non-illustrated operator. A flow chart showing the operation of the aligning device 25 illustrated in FIG. 6 is presented in FIG. 7. In sequence, at 100, the operator detects sheets arriving skewed at the front lays 11 and 13 and thereupon initiates the skewed-sheet correction via an input field 47 (±keys) of the control computer 35. The skewed-sheet correction is then performed by the control computer 35 at 101, i.e., the first motor 33 is activated appropriately by the control computer 35, so that the sheet 5 is pivoted a desired amount about the vertical axis 21. At 102, via the skewed-sheet correction, the control computer 35 calculates the displaced distance S which the pile or stack carrier 41 with the sheet or stack 3 arranged thereon must be displaced transversely with respect to the transport direction y of the sheets, i.e., in the x direction, in order that the desired distance $X_0$ between the side edge 15 of the sheet 5 and the side lay 17 be implemented after the skewed-position correction. At 103 and 104, the control computer 35 therefore moves the stack or pile carrier 41 the calculated distance S in the direction opposite to the displacement which results from the skewed-sheet correction.

The common factor in the exemplary embodiments of the aligning apparatus 25 described using FIGS. 4 to 7 is that the skewed-sheet correction and the lateral displacement of the stack or pile are performed simultaneously or virtually simultaneously.

In a different exemplary embodiment of the aligning device 25, not illustrated in the figures, only the sheet 5 lifted off the sheet stack 3, instead of the entire sheet stack or pile 3, is displaced transversely with respect to the transport direction y of the sheets, to be precise, exactly the distance S which is calculated by the control computer 35 and results from the skewed-sheet correction, in order that a desired distance $X_0$ between the side edge of the respective sheet and the side lay 17 can be implemented. To this end, therefore, the sheet lifting device 27 or the lifting elements 29 thereof holding the top sheet 5 of the sheet pile or stack 3 is displaced the distance S transversely to the transport direction y of the sheets.

We claim:

1. A method of aligning stacked or piled sheets in a feeder of a sheet-processing machine, wherein a sheet to be separated is pivotable about a vertical axis extending substantially orthogonally to a transport direction of the sheet, in order to correct a skewed position of a leading edge thereof relative to at least one front lay, the method which comprises:

determining, relative to the front lay, a skewed position of one of a sheet arriving at the front lay and a sheet on the top of the sheet pile; and displacing, in dependence on the determined skewed position and substantially transversely to the transport direction, one of the sheet pile, before the sheet is lifted from the sheet pile, and the sheet lifted off the sheet pile, over a displacement distance that is of such length that, after the skewed-position correction, there is a defined spaced distance between a side edge of the sheet and at least one side lay.

2. The method according to claim 1, wherein the defined spaced distance after the skewed-position correction is of equal length for all of the separated sheets, respectively.

3. The method according to claim 1, which includes determining the skewed position of the sheet visually by an operator.

4. The method according to claim 1, which includes defining by the operator the adjustment angle by which the sheet to be aligned is pivoted about the vertical axis for the purpose of correcting the skewed position.

5. The method according to claim 1, which includes determining the displacement distance in accordance with an adjustment angle.

6. The method according to claim 1, which includes calculating the displacement distance in accordance with an adjustment angle.

7. The method according to claim 1, which includes automatically registering the skewed position of the sheet with the aid of at least one sensor.

8. The method according to claim 7, which includes calculating by a control and/or regulating device the necessary correction of the skewed position of the sheet in accordance with the determined skewed sheet position.

9. The method according to claim 7, which includes calculating the displacement distance in accordance with the value of the skewed-position correction.

10. The method according to claim 1, which includes activating by the control and/or regulating device actuators associated with the sheet pile and the sheet lifted off the sheet pile in accordance with the calculated skewed-position correction value and the displacement distance.

11. A device for aligning stacked sheets in a feeder of a sheet-processing machine, including a sheet lifting device for lifting a sheet resting on the top of a sheet stack or pile and for pivoting the sheet about a vertical axis extending substantially orthogonally to the transport direction of the separated sheet, comprising at least one of a pile displacement device for displacing the sheet pile substantially transversely to the transport direction of the separated sheets and of at least one lifting element that is displaceable at least transversely to the transport direction of the separated sheets.

12. The device according to claim 11, including a control and/or regulating device for respectively controlling/regulating the pivoting of the sheet, and the displacement of the sheet pile transversely to the transport direction of the separated sheets.

* * * * *